US005622447A

United States Patent [19]

Fournier

[11] Patent Number: 5,622,447

[45] Date of Patent: Apr. 22, 1997

[54] SELF-LEVELING BOAT HULL SUPPORT

[76] Inventor: Oscar A. Fournier, 1859 Shore Dr. South, #208, St. Petersburg, Fla. 33707

[21] Appl. No.: 525,934

[22] Filed: Sep. 8, 1995

Related U.S. Application Data

[63] Continuation-in-part of Ser. No. 370,069, Jan. 9, 1995, abandoned.

[51] Int. Cl.[6] ..... B63C 5/04

[52] U.S. Cl. ..... 405/7; 405/3; 280/414.1

[58] Field of Search ..... 405/3, 4, 7; 280/414.1; 114/44, 45

[56] References Cited

U.S. PATENT DOCUMENTS

| | | | |
|---|---|---|---|
| 1,407,375 | 2/1922 | Burbank . | |
| 1,515,435 | 11/1924 | Glover . | |
| 1,614,131 | 1/1927 | Johnson . | |
| 2,470,396 | 5/1949 | Guerette | 405/7 X |
| 2,503,535 | 4/1950 | Yarbrough | 280/414.1 |
| 3,139,277 | 6/1964 | Mears . | |
| 3,379,314 | 4/1968 | Canning | 280/414.1 X |
| 3,586,285 | 6/1971 | Modzelewski | 405/7 X |
| 4,155,667 | 5/1979 | Ebsen | 405/7 |
| 4,944,633 | 7/1990 | Robb | 405/3 |
| 5,186,576 | 2/1993 | Fournier | 405/7 |

FOREIGN PATENT DOCUMENTS

| | | | |
|---|---|---|---|
| 0919935 | 4/1982 | U.S.S.R. | 405/7 |
| 1036621 | 8/1983 | U.S.S.R. | 405/7 |
| 1202962 | 1/1986 | U.S.S.R. | 405/7 |
| 1232564 | 5/1986 | U.S.S.R. | 405/7 |
| 1331729 | 8/1987 | U.S.S.R. | 405/7 |
| 1384474 | 3/1988 | U.S.S.R. | 405/7 |
| 2092529 | 8/1982 | United Kingdom | 405/7 |

*Primary Examiner*—Tamara L. Graysay
*Assistant Examiner*—Frederick L. Lagman
*Attorney, Agent, or Firm*—Quarles & Brady

[57] ABSTRACT

A boat hull support has a pair of support members each pivotally attached to a respective upright. The inner ends of the support members oppose each other. One of the inner ends mounts a pair of cam plates having aligned banana-shaped cam openings. The other inner end mounts a follower rod received in the cam openings. The cam openings are shaped so that movement of one of the support members about its pivot will be translated into an equal and opposite movement of the other. The support members are urged to a generally horizontal position by leaf springs or elastomer blocks bearing against the underside of the support members.

11 Claims, 3 Drawing Sheets

SELF-LEVELING BOAT HULL SUPPORT

RELATED APPLICATION

This application is a continuation-in-part of my application Ser. No. 08/370,069, filed Jan. 9, 1995, now abandoned.

BACKGROUND OF THE INVENTION

This invention relates to a support for the hull of a boat, and particularly to a self-centering support for use in storage racks or the like.

In my earlier U.S. Pat. No. 5,186,576 issued Feb. 16, 1993, I describe a support for a boat hull which has the feature that the boat is automatically centered in the support as the boat is lowered onto the support. The support of my earlier patent included a central guide post to which a pair of hull support members were joined so that movement of one support member was translated into a like movement of the other. There are instances of use for hull supports where there is insufficient space or clearance for such a guide post. One example is in racks that store boats at levels one above the other.

The present invention is directed to a self-centering hull support that has a low profile and which is therefore usable in storage racks or other environments having space limitations.

SUMMARY OF THE INVENTION

In accordance with the invention, a boat hull support has a pair of hull support members each pivotally mounted intermediate its ends to a respective upright. Inner ends of the support members are adjacent to each other. A cam is attached to the inner end of one of the hull support members and a cam follower is attached to the inner end of the other hull support member and engages the cam. The cam has a cam surface developed to translate movement of one hull support member about its respective upright into an equal and opposite movement of the other hull support member about its respective upright.

In the preferred embodiment, the cam is a pair of spaced plates having identical aligned banana-shaped openings defining the cam surface, and the cam follower is a rod that extends through both of the cam openings. The shape of the opening is determined by the locus of points of the center line of the rod and the center of the opening to maintain the same degree of inclination in each of the two support members as they are rotated from the horizontal.

The invention further resides in a boat hull support which includes springs to normally urge the two support members to a generally horizontal position. In one preferred embodiment, the springs are leaf springs connected to the uprights and which bear on the underside of the support members. Stops are provided to prevent the leaf springs from moving the support members to a position above the horizontal.

In another embodiment, the springs are elastomer blocks mounted on ledges beneath the support member. The elastomer blocks are compressed as the support members are rotated downwardly from the horizontal.

The foregoing and other objects and advantages of the invention will appear in the following detailed description. In the description, reference is made to the accompanying drawings which illustrate a preferred embodiment.

DETAILED DESCRIPTION OF THE PREFERRED EMBODIMENT

Figure 1:
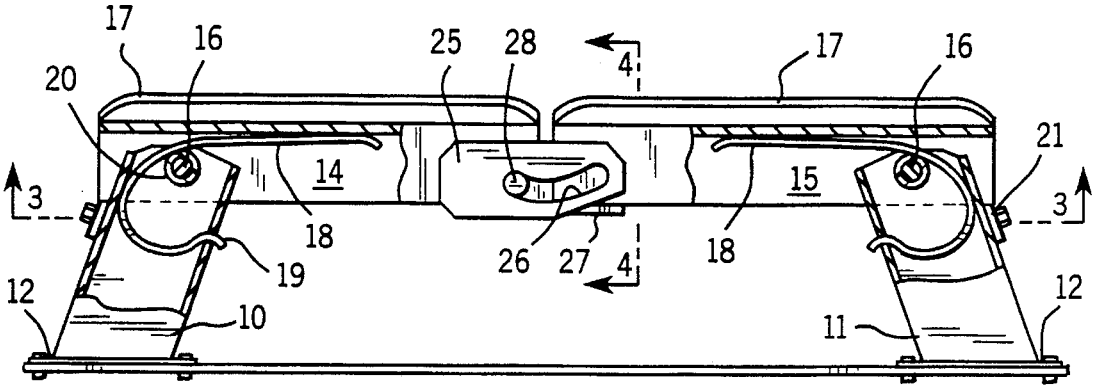
FIG. 1 is a view in elevation, with portions in section, of a boat hull support in accordance with the invention.
Figure 2:
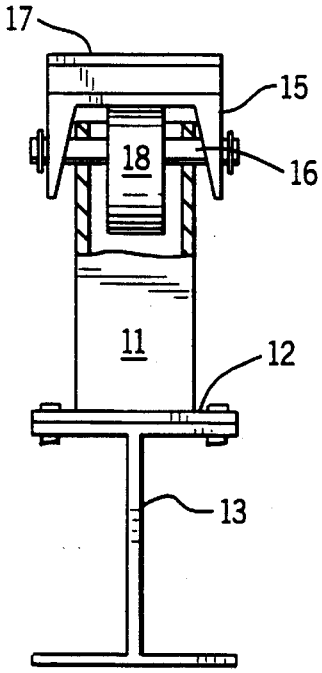
FIG. 2 is an end view of the hull support of FIG. 1.
Figure 4:
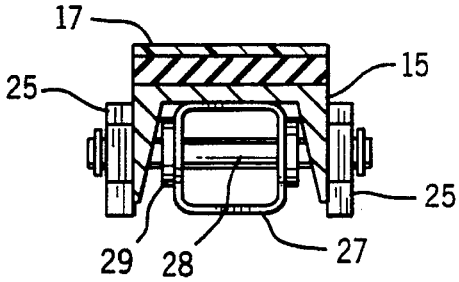
FIG. 4 is a view in vertical section taken in the plane of the line 4—4 in FIG. 1.
Figure 3:
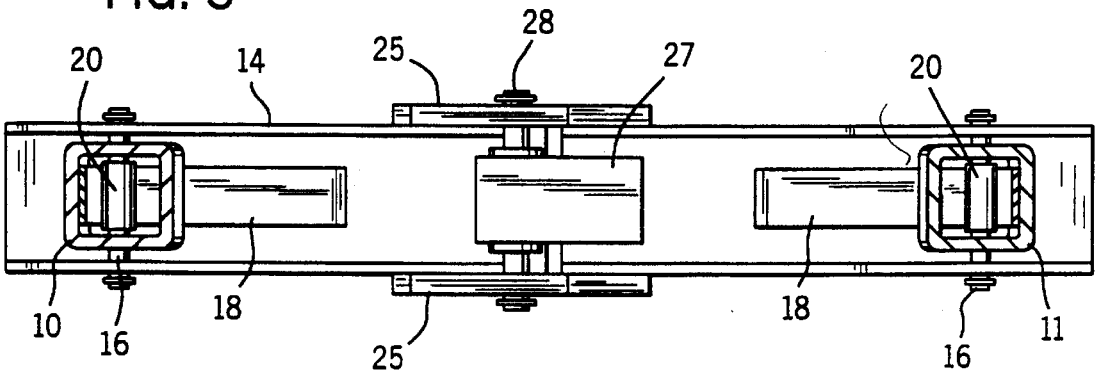
FIG. 3 is a bottom view of the hull support taken in the plane of the line 3—3 of FIG. 1.

The hull set includes a pair of spaced apart uprights 10 and 11 in the form of square metal tubes that are welded to plates 12 for attachment to an I-beam 13 or other supporting element of a storage rack. As seen in the drawings, the uprights 10 and 11 are preferably inclined from the vertical towards each other. A pair of hull support members 14 and 15 in the form of metal structural channels are mounted on pivot pins 16 that extend through opposite sides of the uprights 10 and 11. The width of the channels forming the hull support members 14 and 15 is greater than the width of the uprights 10 and 11 so that the uprights can be accommodated within the flanges of the channels. A layer of ultra-high molecular weight plastic 17 may be mounted along the upper face of each of the support members 14 and 15. Alternatively, the upper faces may be covered by an 80 Durometer formulated natural rubber with a polymer surface fused to the rubber.

In the first embodiment, a leaf spring 18 is disposed beneath each support member 14 and 15 to urge the support members upwardly. Each leaf spring 18 extends around a respective pivot pin 16 and terminates in a tail 19 captured in an opening in the upright 10 or 11. A plastic sleeve 20 surrounds each pivot pin 16 to prevent contact of the pivot pin by the leaf spring 18. Stop blocks 21 are attached to the uprights 10 and 11 to prevent the leaf springs 18 from biasing the support members 14 and 15 to a position above horizontal. The stop blocks 21 are removed during assembly to allow the leaf springs 18 to be preloaded as they are forced to a position where the support members 14 and 15 are horizontal.

The inner ends of the two support members 14 and 15 oppose each other. The inner end of the first support member 14 mounts cam plates 25 on the outside of the flanges of the channel. The cam plates 25 project beyond the inner end of the first support member 14 to extend on either side of the opposing inner end of the second support member 15. The cam plates 25 contain identical cam cut-outs 26 that are generally banana-shaped. A tube 27 is attached to the underside of the second support member 15 and extends between the cam plates 25. The tube 27 mounts a cam follower in the form of a follower rod 28. Washers 29 held in place by cotter pins (not shown) hold the follower rod 28 axially. The cam plates 25 may be welded to the sides of the flanges of the support member 14, or may be attached by bolts received in elongated holes to allow for adjustment of the cam openings 26 relative to the follower rod 28.

The shape of the cam slot 26 is developed so that movement of either of the hull support members 14 or 15 will be translated into an equal and opposite movement of the other support member. The shape is thus developed as the locus of points for increments of movement of the follower rod 28 that will cam the cam plates 25 into an equal movement.

Figure 5:
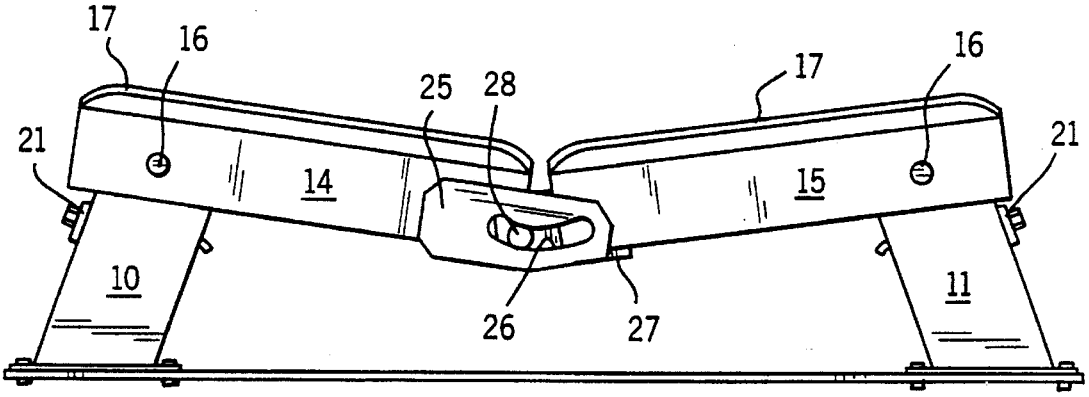
FIG. 5 is a view of the hull support with a boat hull in place.
Figure 6:
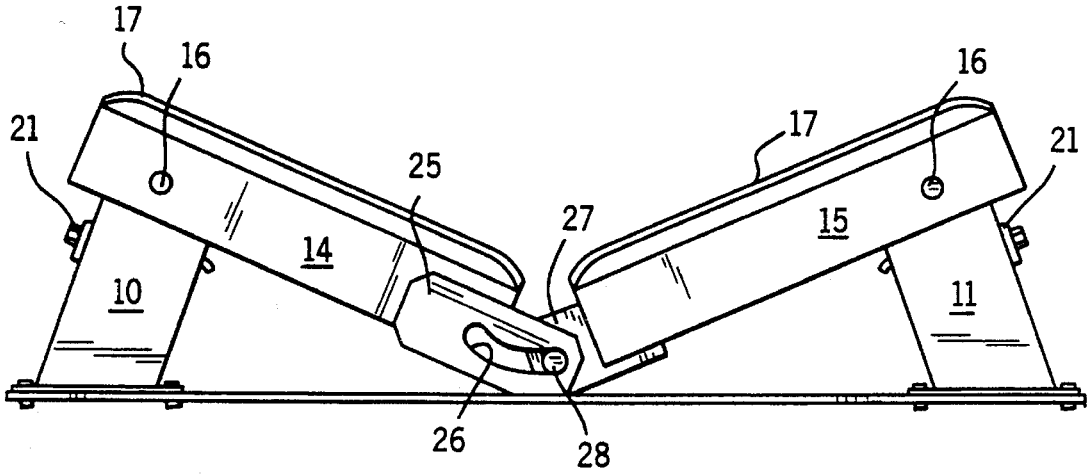
FIG. 6 is a view in elevation of the hull support in its lower-most position.

As shown in FIGS. 5 and 6, the support members 14 and 15 will automatically move in unison to a position that centers the hull of a boat that is placed on the hull support. The support will automatically adjust to boat hulls of various shapes and degrees of inclination.

At the maximum degree of inclination from the horizontal, the cam plates 25 and tube 27 will bottom out on the top of the rack beam 13 or other support. At that point, the follower rod 28 will have moved to one end of the cam slot 26.

Figure 7:
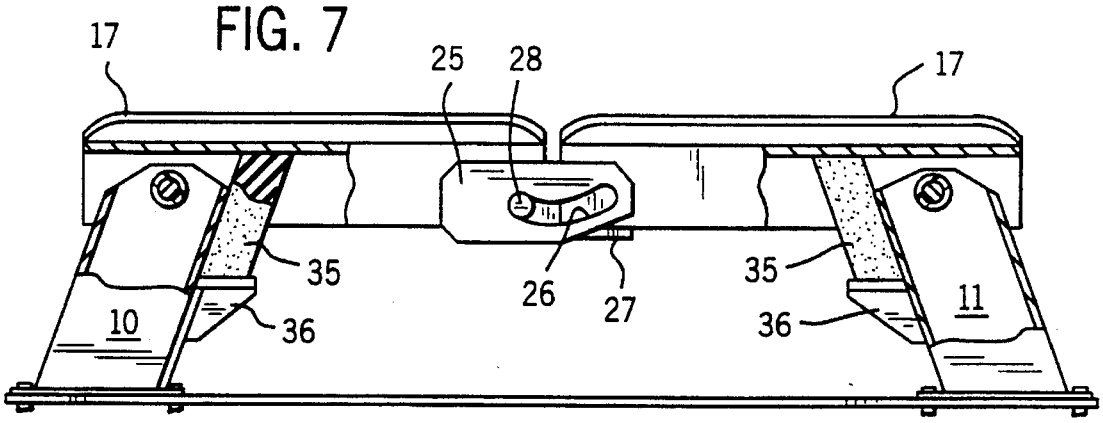
FIG. 7 is a view in elevation, with portions in section, of a second embodiment of the boat hull support that uses elastomer blocks as springs.
Figure 8:
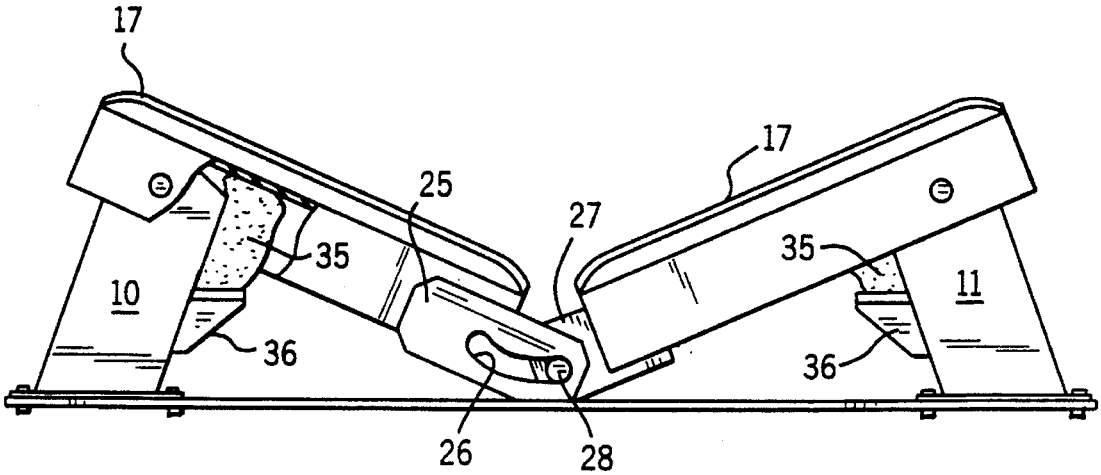
FIG. 8 is a view similar to FIG. 7 but showing the hull support in its lower-most position.

FIGS. 7 and 8 show the use of blocks of an elastomer as springs in place of the leaf springs 18. Specifically, blocks 35 sit on ledges 36 attached to the inside of each upright 10 and 11. The blocks 35 are so dimensioned that they will support the weight of the support members 17 when there is no external load on the support members 17. The blocks 35 are compressed as the support members 17 are moved downwardly under the weight of a boat hull on the support members 17. The energy stored in the compressed blocks 35 is released when the weight is removed and the blocks 35 will restore the support members 17 to a horizontal position.

The blocks 35 may be formed of a natural rubber or a synthetic elastomer such as a polyurethane. An 80 Durometer rubber has proven to be usable.

Although a pair of leaf springs and a pair of blocks are shown, only a single spring could be used. The movement of one of the support members by one spring will be translated into a like movement of the other support member.

The leaf springs 18 or the elastomer blocks 35 could also be used on the hull support of my earlier U.S. Pat. No. 5,186,576 in place of the counterweights disclosed therein.

I claim:

1. A boat hull support, comprising:

a pair of hull support members each pivotally mounted intermediate its ends to a respective upright and having adjacent inner ends;

a cam attached to the inner end of one of the hull support members; and a cam follower attached to the inner end of the other hull support member and engaging the cam, the cam having a cam surface developed to translate movement of one hull support member about its respective upright resulting from a load on the one hull support member into equal and opposite movement of the other hull support member about its respective upright.

2. A boat hull support in accordance with claim 1 wherein the cam comprises a pair of spaced cam plates, each having aligned, identical cam openings, and the cam follower comprises a rod extending through the cam openings.

3. A boat hull support in accordance with claim 2 wherein the cam plates are mounted on opposite sides of the inner end of the one hull support member.

4. A boat hull support in accordance with claim 2 wherein the cam openings are shaped as the locus of points for increments of movement of the rod that will cam the cam plates into an equal movement.

5. A boat hull support in accordance with claim 1 wherein the support members have a top and an underside, together with a spring bearing against the underside of a support member to urge the support members to a generally horizontal position.

6. A boat hull support in accordance with claim 5 wherein the spring is a leaf spring attached at the upright.

7. A boat hull support in accordance with claim 5 wherein the spring is an elastomer block supported on a ledge beneath the underside of a support member.

8. A boat hull support comprising:

a pair of hull support members each pivotally mounted intermediate its ends to a respective upright and having adjacent inner ends;

means joining the inner ends of the hull support members to translate displacement of one of the support members on its pivotal mounting into an equal displacement of the other support member on its pivotal mounting; and a spring urging the support members to a generally horizontal position.

9. A boat hull support in accordance with claim 8 wherein the support members have a top and an underside, and the spring comprises a leaf spring attached at the upright and bearing against the underside of a support member to urge the inner end of the support member upwardly.

10. A boat hull support in accordance with claim 9 together with a stop on the upright that is engaged by the support member to prevent the spring from rotating the inner end of the support member above the horizontal.

11. A boat hull support in accordance with claim 8 wherein the support members have a top and an underside, and the spring comprises an elastomer block supported on a ledge at an upright and bearing against the underside of a support member to urge the inner end of the support member upwardly.

* * * * *

UNITED STATES PATENT AND TRADEMARK OFFICE

CERTIFICATE OF CORRECTION

PATENT NO. : 5,622,447

DATED : April 22, 1997

INVENTOR(S) : Oscar A. Fournier

It is certified that error appears in the above-identified patent and that said Letters Patent is hereby corrected as shown below:

Column 4, claim 8, line 36, after "position" insert --when there is no load on either support member--.

Signed and Sealed this

Seventeenth Day of February, 1998

*Attest:*

*Attesting Officer*

BRUCE LEHMAN

*Commissioner of Patents and Trademarks*